US008376794B2

(12) United States Patent
Hundertmark

(10) Patent No.: US 8,376,794 B2
(45) Date of Patent: Feb. 19, 2013

(54) ELECTROMECHANICALLY ACTUATED STEERING VANE FOR MARINE VESSEL

(75) Inventor: James M. Hundertmark, Fond du Lac, WI (US)

(73) Assignee: Mark X Steering Systems, LLC, Oshkosh, WI (US)

( * ) Notice: Subject to any disclaimer, the term of this patent is extended or adjusted under 35 U.S.C. 154(b) by 123 days.

(21) Appl. No.: 12/915,811

(22) Filed: Oct. 29, 2010

(65) Prior Publication Data

US 2011/0114004 A1 May 19, 2011

Related U.S. Application Data

(60) Provisional application No. 61/256,041, filed on Oct. 29, 2009.

(51) Int. Cl.
*B63H 5/125* (2006.01)

(52) U.S. Cl. ..... 440/61 S; 114/144 RE; 440/51

(58) Field of Classification Search ..... 114/114 R, 114/144 RE; 440/61 S, 51; 180/443, 444
See application file for complete search history.

(56) References Cited

U.S. PATENT DOCUMENTS

| | | | | |
|---|---|---|---|---|
| 4,054,102 | A | 10/1977 | Borst et al. | |
| 4,323,353 | A | 4/1982 | Kirkwood | |
| 4,349,341 | A | 9/1982 | Morgan et al. | |
| 4,362,515 | A | 12/1982 | Ginnow | |
| 4,416,636 | A | 11/1983 | Boda | |
| 4,482,331 | A | 11/1984 | Boda | |
| 4,500,298 | A | 2/1985 | Hall et al. | |
| 4,509,924 | A | 4/1985 | Hall | |
| 4,592,732 | A | 6/1986 | Ferguson | |
| 4,632,049 | A | 12/1986 | Hall et al. | |
| 4,693,689 | A | 9/1987 | Harada | |
| 4,759,732 | A | 7/1988 | Atsumi | |
| 4,762,079 | A | 8/1988 | Takeuchi et al. | |
| 4,787,867 | A | 11/1988 | Takeuchi et al. | |
| 4,908,766 | A * | 3/1990 | Takeuchi | 701/21 |
| 5,097,714 | A | 3/1992 | Kabuto et al. | |
| 5,105,924 | A | 4/1992 | Carlson | |
| 5,266,060 | A | 11/1993 | Onoue | |
| 6,053,274 | A * | 4/2000 | Ehara et al. | 180/444 |
| 6,113,443 | A | 9/2000 | Eichinger | |
| 6,341,992 | B1 | 1/2002 | Eglinsdoerfer et al. | |
| 6,763,907 | B2 * | 7/2004 | Ueno et al. | 180/444 |
| 6,883,451 | B2 | 4/2005 | Takada et al. | |
| 7,267,069 | B2 | 9/2007 | Mizutani | |
| 7,494,390 | B2 | 2/2009 | Mizutani | |
| 2006/0045715 | A1 * | 3/2006 | Honermann et al. | 414/723 |

* cited by examiner

*Primary Examiner* — Stephen Avila
(74) *Attorney, Agent, or Firm* — Boyle Fredrickson, S.C.

(57) ABSTRACT

A steering assist system for a marine vessel includes a steering vane extending into water in the vicinity of a steering device for the vessel and that is pivotable about an at least generally vertical axis by an electromechanical drive unit. The drive unit is energized by an actuator assembly in response to the imposition of external forces on the steering system. The actuator assembly includes an actuator that is movable in response to the imposition of external forces in the steering system and a switch that is selectively engageable by the actuator arm to energize the drive unit to drive the steering vane to pivot. The actuator assembly may comprise a biasing assembly that resists movement of the actuator creating a force threshold that must be overcome to engage the switch. The biasing assembly may take the form of one or more springs, preferably having a settable preset.

5 Claims, 5 Drawing Sheets

ELECTROMECHANICALLY ACTUATED STEERING VANE FOR MARINE VESSEL

CROSS REFERENCE TO A RELATED APPLICATION

The present application claims the benefit of U.S. Ser. No. 61/256,041, filed Oct. 29, 2010, the disclosure of which is incorporated herein in its entirety.

BACKGROUND OF THE INVENTION

1. Field of the Invention

The invention relates to marine steering systems and, more particularly, relates to a method and apparatus for controlling operation of a steering vane or tab that counteracts externally imposed steering torques imposed on the outboard engine or other steering device of a vessel.

2. Discussion of the Related Art

Marine steering systems sometimes employ a moveable steering vane or tab that moves so as to counteract external forces imposed on the steering device of the vessel, reducing or negating the need for the operator to impose steering forces to counteract these forces. These devices most typically are used in conjunction with outboard engines, in which case the engine itself is the steering device and is steered by pivoting about a vertical axis. In this case, the steering vane typically is disposed within the slip stream of the propeller of the outboard engine to channel the water in the strip stream in a manner that opposes external forces imposed on the engine during operation. Publications describing these systems often refer to the actuated vane or tab as a trim tab. However, such a reference is not technically accurate when referring to tabs that pivot about a vertical axis because trim tabs most typically pivot about a horizontal axis to adjust the fore-to-aft orientation or "trim" of a boat. Accordingly, this document utilizes the term "steering vane" or "steering tab" to refer to a structure that pivots about an at least generally vertical axis or otherwise moves at least generally from side to side to counteract externally forces imposed externally on a rudder, outboard engine, or other steered device during operation.

Most steering vanes employed to date are operated mechanically and passively, such as by using the combination of a push pull cable and a passive hydraulic cylinder. One such vane is disclosed in U.S. Pat. No. 4,482,331, the subject matter of which is hereby incorporated by reference. Another example is disclosed in U.S. Pat. No. 4,349,341 (the '341 patent) to Morgan et al., the subject matter of which is also incorporated by reference. The '341 patent discloses the use of a control lever pivotally mounted to the steering control element of the boat. Movement of the lever in one direction or the other by the steering control element generates tensile forces in an appropriate control cable to pivot a steering vane.

One shortfall of the system disclosed in the '341 patent is the inclusion of a lost motion linkage between the steering arm and the control rod of the steering mechanism of a boat. The necessity of a lost motion linkage creates a lag in steering response, which can affect the handling of a boat. Another disadvantage of this type of system is that the lost motion linkage potentially allows the propulsion unit to be steered by external forces such as waves or current, which will cause course deviations. Passive systems also necessarily have limited effectiveness at counteracting forces imposed on the steering device.

Computer based actuator systems have been developed to in an attempt to address at least some the disadvantages of passive mechanical based systems. For instance, U.S. Pat. No. 4,787,867 (the '867 patent) to Takeuchi et al., discloses a steering vane or tab that is supported on the propulsion unit of a marine engine and that can be pivoted in a direction opposite to the operator's steering direction so as to create a hydrodynamic force to assist in the steering of a vessel immediately upon the detection of a given steering import force. The steering vane position, however, is determined by a computer system using a selected one of plurality of pre-mapped positions. Such a system is at the mercy of the accuracy of the pre-mapped positions and on the operator's ability to select the appropriate map. Furthermore, a computerized system of this type must be customized to particular boat characteristics such as engine and propeller characteristics, trim settings, and overall boat designs. Such a system therefore is relatively expensive and difficult to implement. It also cannot be used, without modification, on a variety of different vessels or retrofitted onto an existing vessel.

It thus would be desirable, in a marine steering system, to automatically actuate a powered steering vane to actively reduce or counteract the external forces imposed on the steering system of a boat or other marine vessel during operation.

It would also be desirable to provide a marine steering system which lacks a substantial lost motion connection in the actuating system for the steering vane or tab thereof and which, therefore, does not induce a lag to an operator-initiated steering command response.

It is yet further desirable to provide a steering vane actuator assembly that is versatile so as to be capable of being attached to or retrofitted on a variety of boats without reconfiguration.

SUMMARY OF THE INVENTION

In accordance with a first aspect of the invention, a steering system for a marine vessel includes a steering vane that extends into the water in the vicinity of a steering device for the vessel. The steering vane preferably is pivotable about an at least generally vertical axis and is driven by an electromechanical drive unit. An electromechanical drive unit is energized by an actuator assembly in response to the imposition of external forces on the steering system. The actuator assembly includes an actuator that is movable in response to the imposition of external forces in the steering system and a switch that is selectively engageable by the actuator to energize the drive unit to drive the steering vane to pivot or otherwise move.

The actuator assembly preferably comprises a biasing assembly that resists movement of the actuator to create a force threshold that must be overcome to engage the switch. The biasing assembly may take the form of one or more springs, preferably having a settable preset.

The steering vane and its actuator assembly may be used with, along other things, either mechanically or hydraulically steered vessels. If used with a mechanically steered vessel, the actuator assembly preferably is actuated mechanically and may be employed within or at an end of a steering linkage connecting a push-pull cable or the like to a steering arm. For instance, the actuator could be a pivoting arm driven by the steering system.

If used with a hydraulically steered vessel, the actuator assembly preferably is actuated hydraulically and is fluidically coupled to a steering cylinder for the vessel. For instance, the actuator could be a lever arm responsive to movement of a hydraulically driven piston.

The invention additional relates to a method of automatically actuating an electromechanically driven steering vane of a marine vessel to counteract external forces imposed on the vessel's steering system during operation.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Electromechanically actuated steering vanes constructed in accordance with the present invention may be used on a variety of marine vessels powered by a variety of propulsion systems and steered by a variety of steering devices. For instance, they are usable with boats and other vessels having either an inboard engine or an outboard engine. They could also be used with vessels whose rudder or other steering device is either integrated with the engine, as is typically the cause with an outboard engine, or is separate from the engine. Hence, while embodiments of the invention will now be described primarily in conjunction with relatively small boasts powered and steered by outboard engines having integrated rudders, the invention is in no way limited to those embodiments.

Figure 1:
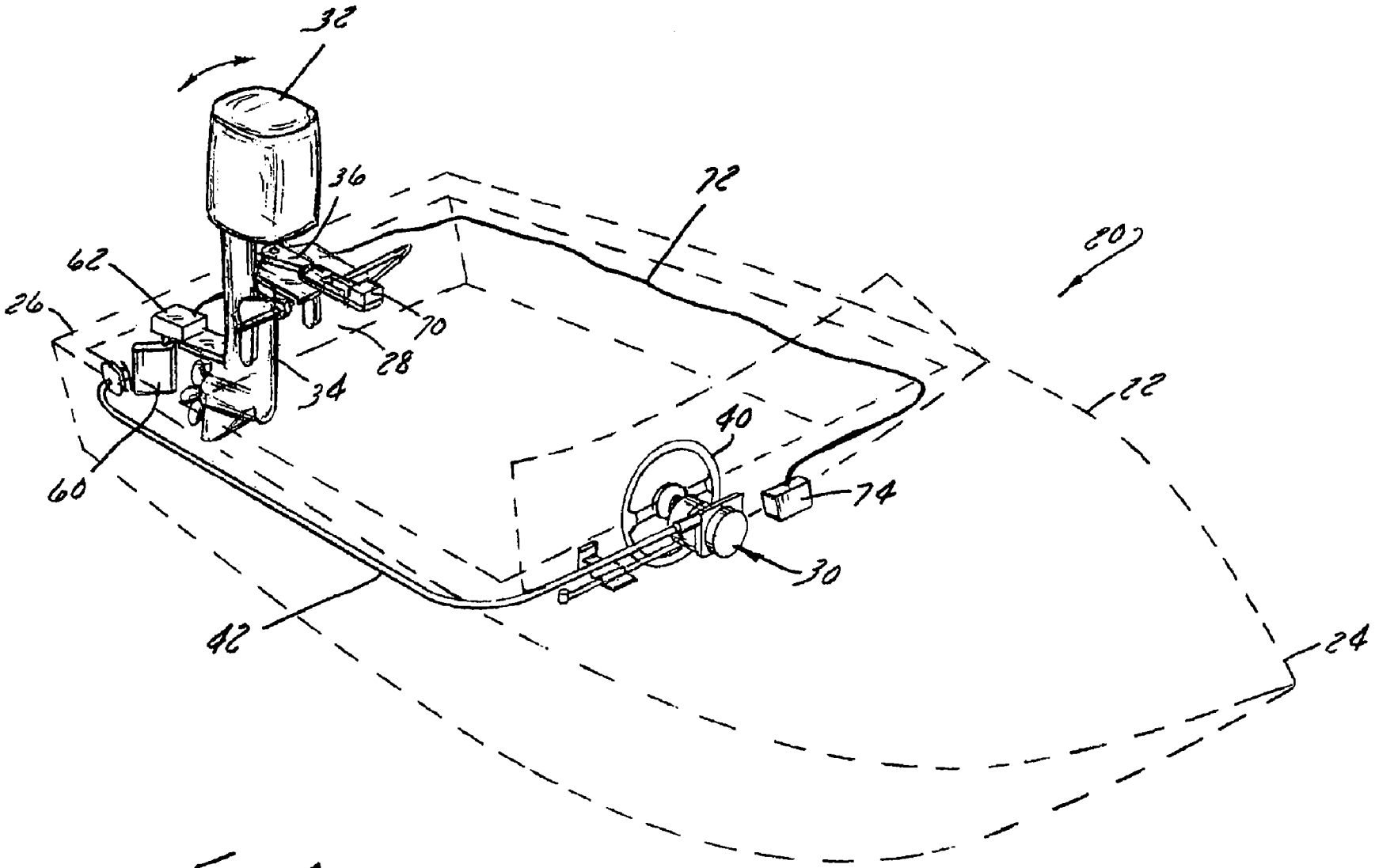
FIG. 1 is a schematic perspective view of a boat the steering system of which incorporates an electromechanically driven steering vane constructed and actuated in accordance with a preferred embodiment of the present invention.
Figure 2:
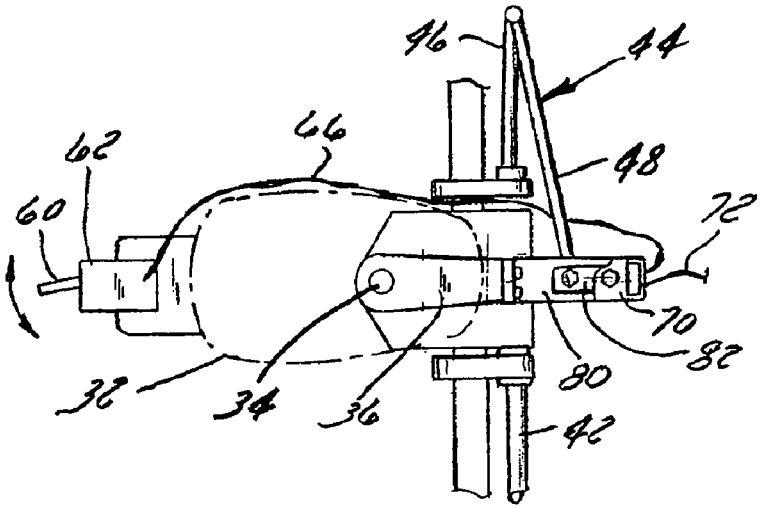
FIG. 2 is a top plan view of the steering vane and related components of the boat.
Figure 3:
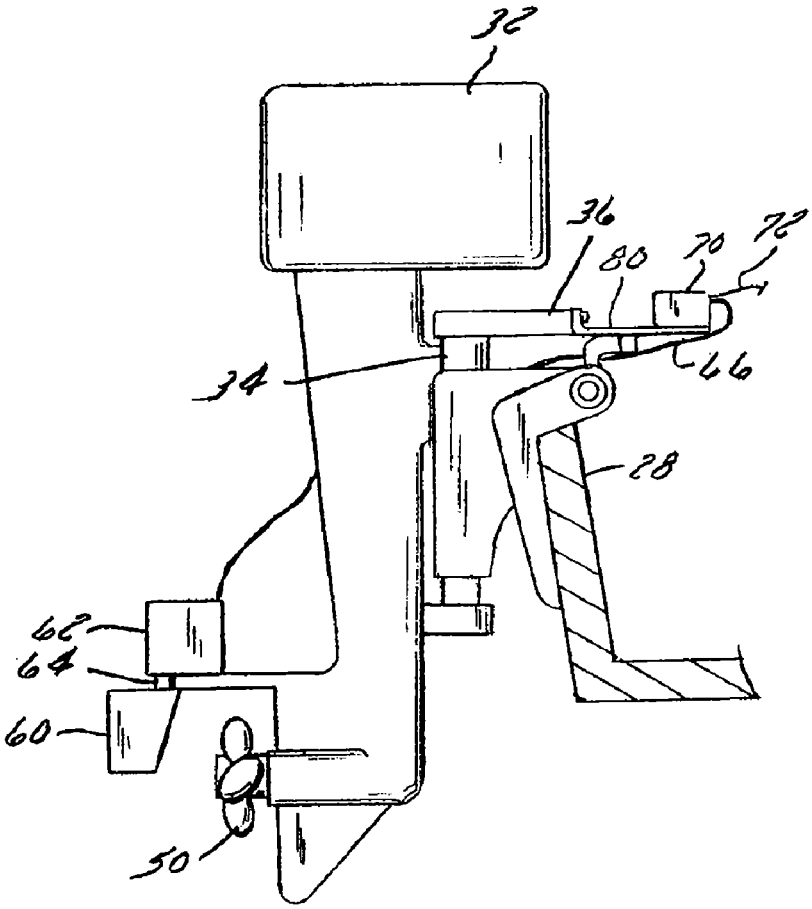
FIG. 3 is a side elevation view thereof.

Referring to FIG. 1, a boat 20 incorporating an electromechanically actuated steering vane constructed in accordance with a first preferred embodiment of the present invention is illustrated at least someone schematically. The boat 20 of FIG. 1 includes a hull 22 having a bow 24, a stern 26, and a transom 28 formed on the stern 26 of the hull 22. The boat 20 also includes a helm assembly 30 and an outboard engine 32 mounted on the transom 28. The engine 32 is pivotable about a generally vertical axis 34 under the application of steering forces transmitted from the helm assembly 30 via a steering arm 36. The helm assembly 30 includes a steering wheel 40 and a flexible push-pull cable 42 that responds to steering wheel rotation. The push-pull cable 42 extends to the stern 26 of the boat 20 and is operatively connected to the steering arm 36 by a linkage assembly 44. Referring to FIGS. 2 and 3, the linkage assembly 44 includes a first link 46 that may be formed from an end of the cable 42 and a second link 48 that is operatively connected to the first link 46 at one end thereof and to the steering arm 36 (via an adapter plate 80 of an actuator assembly 70) at the other end thereof. The steering arm 36 is able to respond to the linear movement of the push-pull cable 42 to pivot the engine 32 about the axis 34 in the commanded direction to steer the boat 20.

Referring particularly to FIGS. 2 and 3, a steering vane or tab 60 is mounted on the rear of the engine 32 and extends downwardly into the slipstream created by the engine's propeller 50. The steering vane 60 is connected to an electromechanical drive unit 62 by a shaft 64 so as to be pivotal about an at least generally vertical axis. The drive unit 62 may be any electrically powered motor or other electromechanical drive capable of driving the steering vane 60 to pivot about shaft 64. It preferably contains a permanent magnet DC motor. The drive unit 62 is electrically connected to an actuator assembly 70 by a wire or cable 66. The actuator assembly 70 is, in turn, connected to a cable 72 leading to a main fuse box 74 of the boat 20 (FIG. 1). The actuator assembly 70 is responsive to the application of external forces to engine 32 to activate the drive unit 62 to drive the steering vane 60 to pivot about its vertical axis to counteract the external forces.

Figure 4:
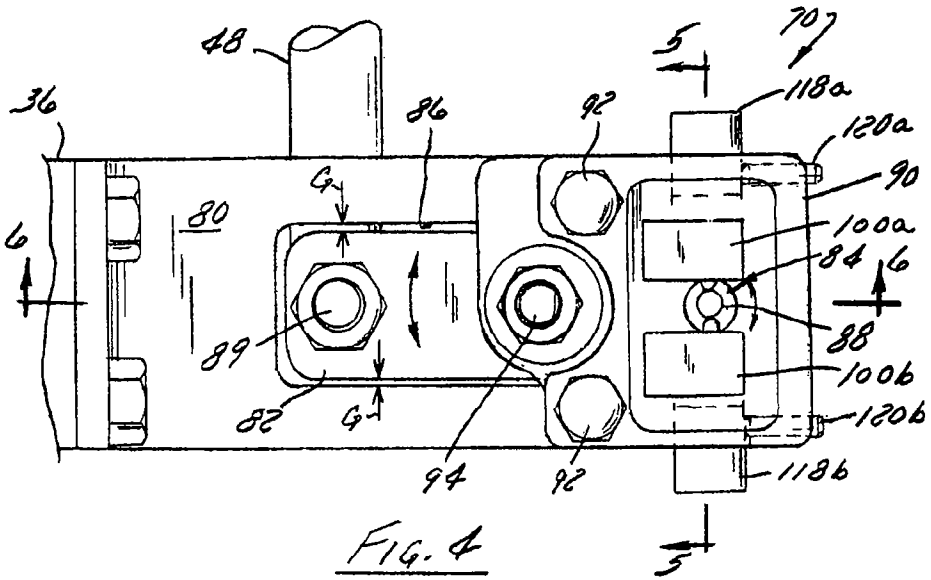
FIG. 4 is a top plan view of an actuator assembly for the steering vane of FIGS. 1-3.
Figure 6:
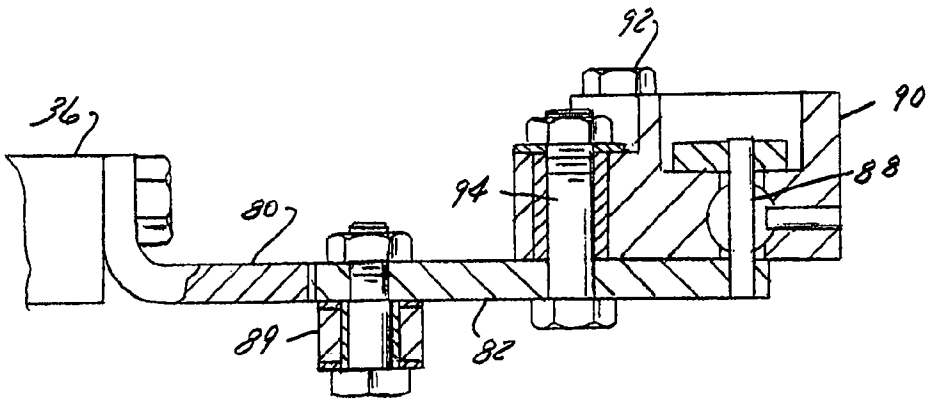
FIG. 6 is an end sectional elevation view of the actuator assembly of FIG. 4, taken generally along the lines 6-6 in FIG. 4.
Figure 5:
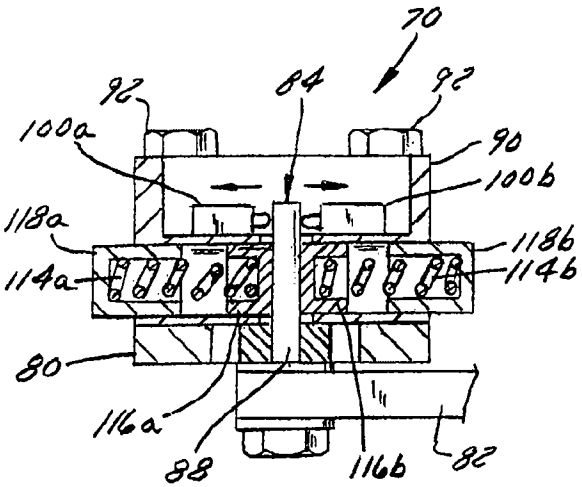
FIG. 5 is a side sectional elevation view of the actuator assembly of FIG. 4, taken generally along the lines 5-5 in FIG. 4.
Figure 7:
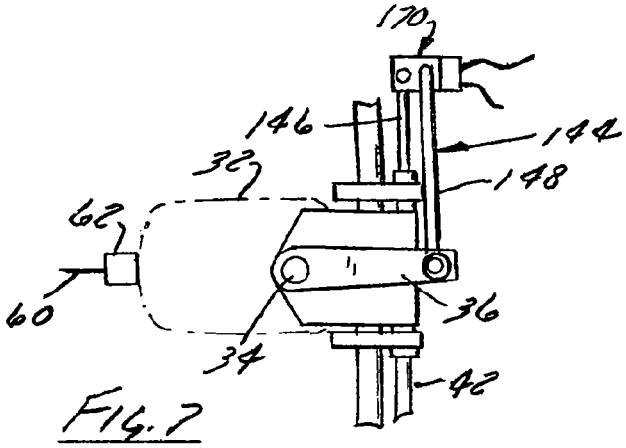
FIG. 7 is a top plan view of a portion of a marine steering assist system constructed in accordance with a second embodiment of the invention.

Referring now to FIGS. 4-6, the actuator assembly 70 includes an adapter plate 80, an actuator arm 82, and a switch assembly 84. The actuator arm 82 is connected to the steering linkage assembly 44 and is mounted for limited movement with respect to the adapter plate 80. The switch assembly 84 is responsive to that limited actuator arm movement to actuate the drive unit 62.

The adapter plate 80 comprises rigid L-shaped plate that is bolted or otherwise attached to the steering arm 36 at its rear end and that has a slot 86 formed in its front end. The actuator arm 82 is centered in the slot 86 in the adapter plate 80 with a gap "G" formed on either side of the actuator arm 82. The width of each gap G represents the maximum distance the actuator arm 82 can move relative to the adapter plate 80. An actuator pin 88 extends vertically upwardly from a front end of the actuator arm 82. The second end of second link 48 of the steering linkage 44 is pivotally connected to the actuator arm 82 near the rear end thereof via a bolt and bushing assembly 89. The link 48 is stationary in a no-steer situation.

Still referring to FIGS. 4-6, the switch assembly 84 is maintained in a switch housing 90 that is mounted on the front end of the adapter plate 80 by bolts 92. The switch housing 90 also is pivotally attached to the actuator arm 82 by a bolt and bushing assembly 94 extending through the actuator arm 82 between the bolt and bushing assembly 89 and the actuator pin 88.

As can be seen in FIG. 5, the switch housing 90 houses two switches 100*a* and 100*b* located on opposite sides of the actuator pin 88. These switches 100*a* and 100*b* have plungers that are in contact with the actuator pin 88. Depression of one of the plungers will activate the corresponding switch 100*a* or 100*b* to activate the drive unit 62 to pivot the steering vane 60 in one direction or the other.

The switch housing 90 also contains a biasing assembly that resists pivoting movement of the actuator arm 82 relative to the adapter plate 80, hence setting a resistance or force threshold that must be overcome to activate the drive unit 62. The threshold preferably is between 5 and 10 lbs. In this embodiment, the biasing assembly takes the form of a spring assembly 110 mounted in a cross bore 112 in the switch housing 90 as best seen in FIG. 5. Spring assembly 110 includes two springs 114*a* and 114*b*, two inboard spring guides 116*a*, and 116*b*, and two outboard spring retainers 118*a* and 118*b*. Each spring 114*a* or 114*b* abuts against an associated side of the actuator pin 88 via the associated spring guide 116*a* or 116*b*. The positions of the outboard spring retainers 118*a* and 118*b* within the bore 112 are adjustable using set screws 120*a* and 120*b* (FIG. 4), hence permitting the pretension on the springs 114*a* and 114*b* to be adjusted to adjust the reaction force threshold that must be applied on the actuator assembly 70 by the engine 32 to activate the drive unit 62.

The switches 100*a* and 100*b* in this system preferably are wired in a way that, when they are not activated, the two wires leading from the switches are shorted together. This shorting generates an electromagnetic pulse in the motor of the drive unit 62 that acts as a brake to stop the motor immediately upon switch deactivation. This feature stops the steering vane 60 from continued movement after the drive unit 62 has been deenergized.

In use, the steering link 48 is stationary in a no-steer situation. If a reaction force, applied to the adapter plate 80 by the engine 32 and the steering arm 36, is of sufficient magnitude to overcome the spring pressure of one the springs 114*a* and 114*b*, the actuator arm 82 will pivot relative to the adapter plate 80 and the switch housing 90 through a stroke determined by the width of the associated gap "G". This pivoting will cause the actuator pin 88 to activate one of the switches 100*a* or 100*b*. The switch 100*a* or 100*b* will energize the motor in the drive unit 62, which will rotate the steering vane 60 in a direction to counter the force applied to the adapter plate 80 by the engine 32. When the force applied to the adapter plate 80 becomes less than the spring-applied force, the actuator arm 82 will move back to its centered neutral position under the spring force. The switch 100*a* or 100*b* will be deactivated, and the motor in the control until 62 will stop the movement of the steering vane 60. At this time, the outboard engine 32 can be steered without further movement of the steering vane 60 if the external operating parameters remain beneath the threshold determined by the spring 114*a* or 114*b*. If the external operating parameters change and the load imposed on the adapter plate 80 becomes high enough to overcome the spring force keeping the actuator arm 82 centered within the slot 86, the position of the steering vane 60 will again be adjusted to compensate for the change in the external operating parameters.

Referring now to FIGS. 7-11, a second embodiment of the invention is illustrated that differs from the first embodiment primarily in that the actuator assembly 170 is mounted within the steering linkage 148 rather than between the steering linkage and the engine steering arm 36. The engine 32, helm 30, etc. are thus identical to the first embodiment. The actuator assembly 170 of this embodiment includes a stationary bracket 180 and a movable actuator arm 182. Stationary bracket 180 is attached to the steering cable or link 146 by a bolt 184. The actuator moveable arm 182 is free to pivot about bolt 184. A link 148 is pivotally attached to the actuator arm 182 at one end thereof and to the steering arm of the engine at the other end thereof.

Figure 11:
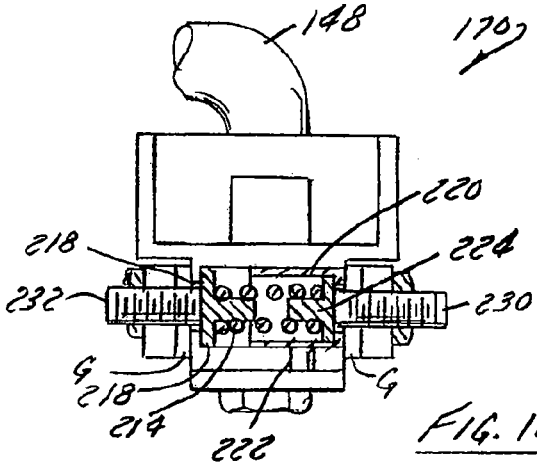
FIG. 11 is a sectional elevation view of the actuator assembly of FIGS. 8-10, taken generally along the lines 11-11 in FIG. 10.

The actuator arm 182 is held in a center position with respect to the bracket 180 by a spring assembly which, like the spring assembly of the first embodiment, sets an initial or threshold force that the engine will have to apply to the actuator arm 182 before the steering vane 60 will be moved. As best seen in FIG. 11, the spring assembly includes a single spring 214 housed in a bore 216. One end of spring 214 holds a spring guide 218 against one end of the bore 216. A sleeve 220 is held in place on the other end of the bore 216 by a set screw 222 that sets the position of the sleeve 220 to determine the preset of the biasing force imposed by the spring 214. The other end of the spring 214 forces a spring guide 224 against the end of the sleeve 220.

When the actuator arm 182 is moved in one direction or the other by forces imposed thereon by the engine 32, the associated spring guide 218 or 224 will compress the spring 214 to generate a force tending to move the actuator arm 182 back to its center position.

Centering screws 230 and 232 also are housed in the bracket 180. The screws 230 and 232 center the actuator arm 182 within the bracket 180 and create an equal gap "G" between each side of the actuator arm 182 and the bracket 180. This gap defines the maximum movement that arm 182 can move with respect to the bracket 180. Centering screws 230 and 232 are adjustable to come into contact with the spring guides 218 and 224.

Figure 8:
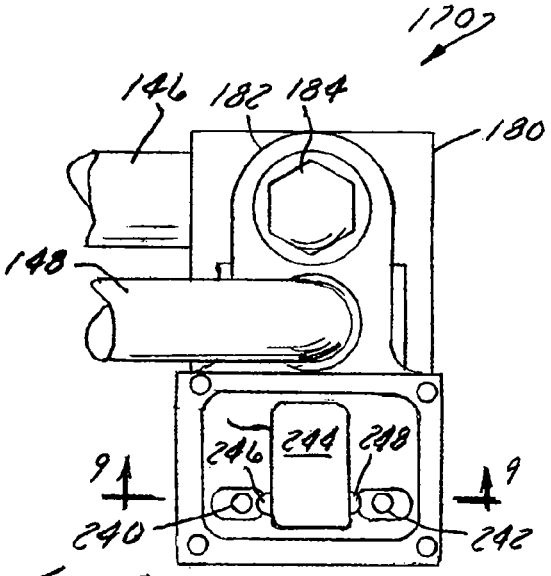
FIG. 8 is a top plan view of an actuator assembly for a steering vane of the steering system of FIG. 7.
Figure 10:
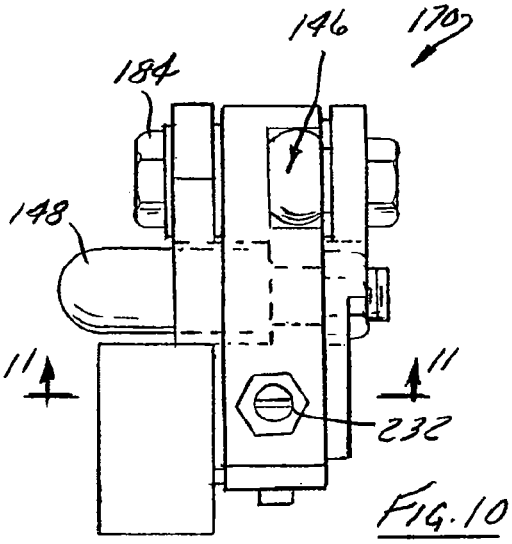
FIG. 10 is an end elevation view of the actuator assembly of FIGS. 8 and 9.
Figure 9:
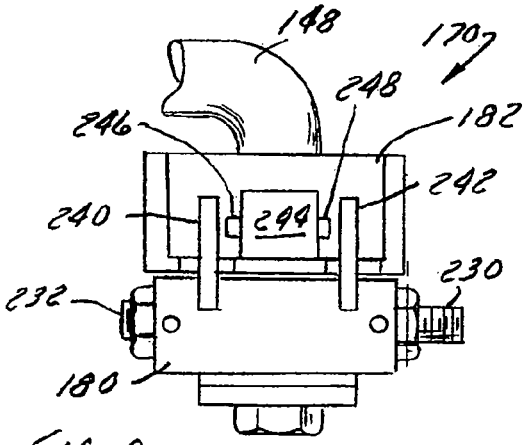
FIG. 9 is a sectional elevation view of the actuator assembly of FIG. 8, taken generally along the lines 9-9 in FIG. 8.

Referring especially to FIGS. 8 and 9, a pair of actuator pins 240 and 242 is mounted on the bracket 180, and a switch 244 is mounted on the actuator arm 182 between the pins 240 and 242. Movement of the actuator arm 182 in one direction or another will cause one of two plungers 246 and 248 on the switch 244 to engage an associated actuator pin 240 or 242 to activate the switch 244 and energize the drive unit 62 to drive the steering vane to move in one direction or the other.

The operation of the system is as follows. Under a no-steer condition, the steering cable 146 is stationary. When the engine 32 produces a force in one direction or the other, the cable 146 and link 148 will move actuator arm 182 in that direction. Movement of the actuator arm 182 causes one of the actuator pins 240 or 242 to be contacted with the plunger 244 or 248 of the switch 244, activating the switch 244 and actuating the drive unit 62 to pivot the steering vane 60 (FIGS. 1 and 2) a direction to counteract the force produced by the engine 32.

Figure 12:
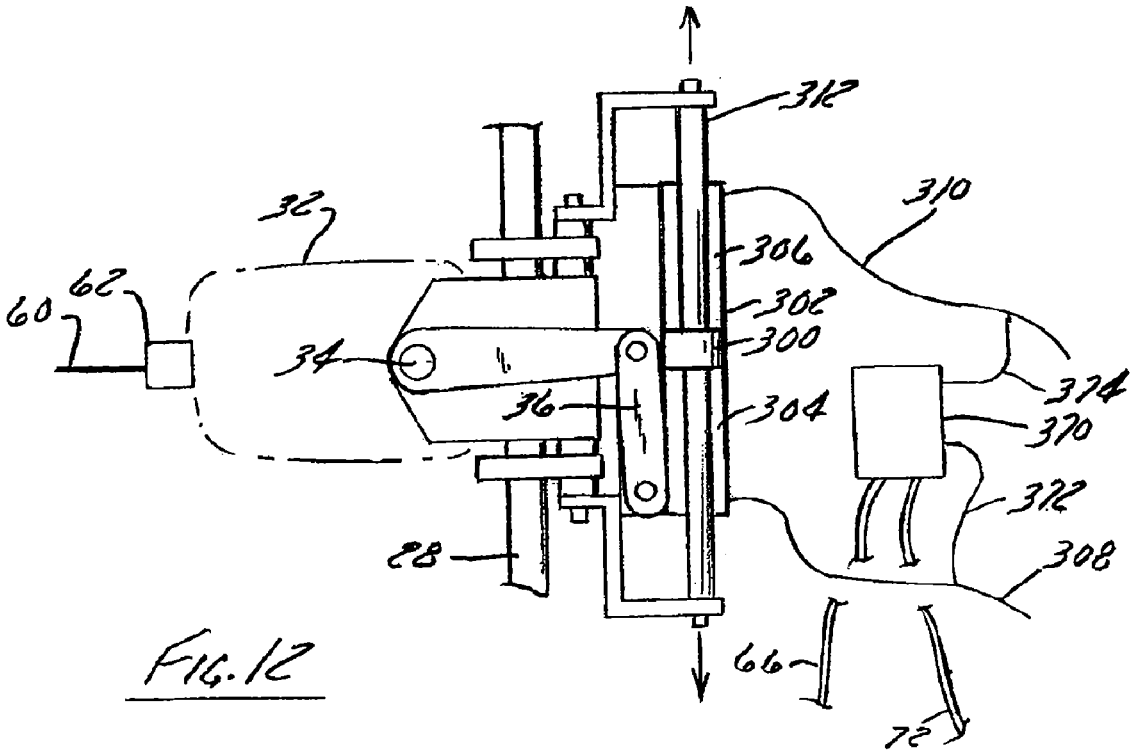
FIG. 12 is a top plan view of a portion of a marine steering system constructed in accordance with a third embodiment of the invention.
Figure 13:
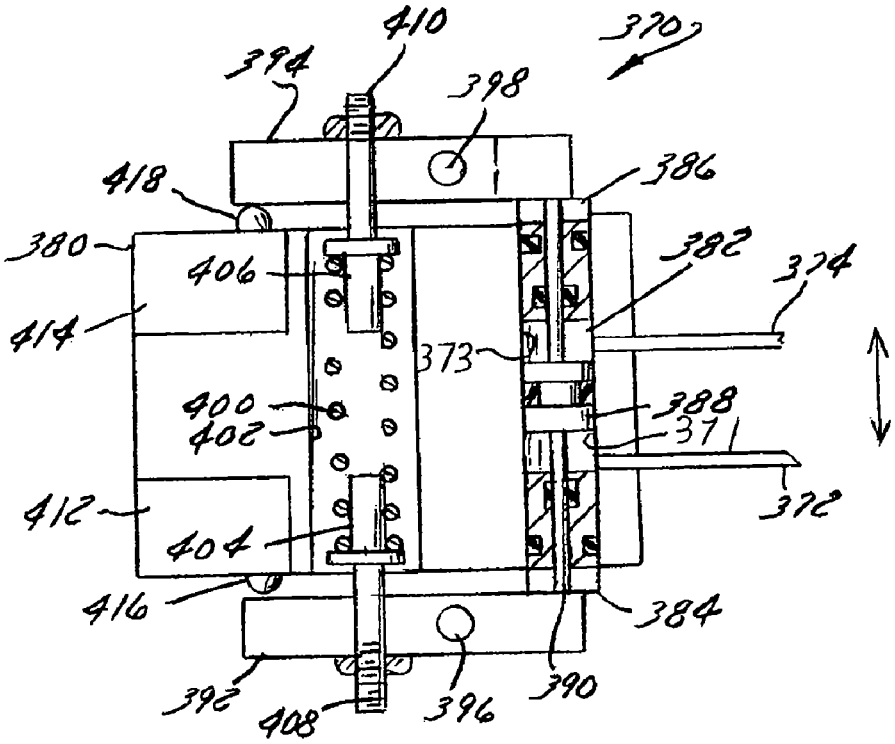
FIG. 13 is a sectional view view of an actuator assembly for a steering vane of the steering system and related components of FIG. 12, taken generally along lines 13-13 in FIG. 12.

Turning now to FIGS. 12 and 13, another embodiment of the invention is illustrated that is applicable to a hydraulically steered system. The engine 32, vane 60, and drive unit 62 of this embodiment are identical to those of the first two embodiments. In this embodiment, the engine 32 is pivoted by a piston 300 that is movable axially within a cylinder 302 in either direction. Pressurized fluid flows to and from chambers 304 and 306 on opposed sides of the piston 300 via hydraulic lines 308 and 310 attached to the helm assembly (not shown). A link 312 is attached to opposed axial ends of the piston 300, extends through opposed ends of the cylinder 302, and is attached to the engine steering assembly 370.

Still referring to FIG. 13, the actuator assembly includes a self contained unit 370 coupled to the steering cylinder 302 by hydraulic lines 372 and 374 teed to the lines 308 and 310, respectively. The unit 370 includes a housing 380 having a bore 382 formed therein that is sealed at its opposed ends by end caps 384, 386. A piston 380 is disposed in the bore 382 between first and second chambers 371 and 373, each of which opens into an associated one of the lines 372, 374. A rod 390 extends through the piston 388 and the end caps 384 and 386, where it engages opposed lever arms 392 and 394 disposed adjacent opposite sides of housing 380. Each lever arm 392, 394 rotates about an associated pin 396, 398 located behind piston 390. The lever arms 392 and 394 are biased into a neutral position by a spring 400 mounted in a bore 402 formed into the housing 380 behind the pivot pins 396, 398. Each end of the spring 400 rests against a spring guide 404, 406. Each spring guide 404, 406 rests against an adjustment screw 408, 410 threaded through the associated lever arm 392, 394. The pretension of the spring 400, and hence the force required to actuate the steering vane 60, can be adjusted by rotating one or both of the threaded adjustment screws 408 and 410. Switches 412 and 414 are mounted on the housing 380 behind the adjustment screws 408 and 410. Each switch contains a plunger 416, 418 that is engaged upon pivoting movement of the associated lever arm 392, 394 to activate the associated switch and energize the drive unit 62 to pivot the steering vane 60 in the appropriate direction.

In operation, engine movement in response to external forces generates a force that is transmitted to the steering cylinder 302 by way of steering arm 36. That force causes the piston 300 to move in one direction or the other relative to the cylinder 302, causing hydraulic fluid to flow out of one of the chambers 304 or 306 and into the other 306 or 304. This fluid flow will create a pressure differential between the chambers 371 and 373 on the opposed sides of the actuator assembly piston 388, forcing the rod 390 towards one of the lever arms 392 or 394. When the pivoting forces imposed on the relevant lever arm 392 or 394 by this pressure differential are high enough to overcome the biasing force of the spring 400, the piston 388 and the rod 390 will move in one direction or the other, causing the associated lever arm 392 or 394 to depress the associated switch plunger 416 or 418. This plunger depression will activate the associated switch 412 or 414, energizing the drive unit 62 to move the steering vane 60 to counter the force created by engine 32.

Many changes and modifications could be made to the invention without departing from the spirit thereof. For instance, the system need not be used with a traditional tiller-based steering system. For instance, the system of FIGS. 12 and 13 can be used with a tiller-based steering system having a hydraulic lock as disclosed and claimed in U.S. Pat. No. 7,325,507, the subject matter of which is hereby incorporated by reference. When the system is used with the hydraulic lock, a second set of switches is needed. These switches are activated by movement of the tiller handle, and they override switches 412 and 414 of the actuator assembly 370.

I claim:

1. A steering system for a marine vessel, comprising:

(A) a steering vane that extends into the water in the vicinity of a steering device for the vessel;

(B) an electromechanical drive unit that drives the steering vane to pivot;

(C) an actuator assembly that energizes the drive unit, the actuator assembly including a. an actuator that is coupled to the steering device so as to be movable by the steering device upon the imposition of external forces thereon, and b. a switch that is selectively engageable by the actuator to energize the drive unit to drive the steering vane to move so as to counteract the external forces imposed on the steering device;

wherein the actuator assembly further comprises a biasing assembly that resists movement of the actuator to create a force threshold that must be overcome by the actuator to engage the switch.

2. The marine steering assembly of claim 1, wherein the force threshold is between 5 and 10 lbs.

3. A steering system for a marine vessel, comprising:

(A) a steering vane that extends into the water in the vicinity of a steering device for the vessel;

(B) an electromechanical drive unit that drives the steering vane to pivot;

(C) an actuator assembly that energizes the drive unit, the actuator assembly including a. an actuator that is coupled to the steering device so as to be movable by the steering device upon the imposition of external forces thereon, and b. a switch that is selectively engageable by the actuator to energize the drive unit to drive the steering vane to move so as to counteract the external forces imposed on the steering device;

wherein the actuator includes an actuator arm, and wherein the actuator assembly further includes 1) a switch housing that supports the switch and 2) an adapter plate to which the actuator housing is fastened and which has a slot formed therein, and wherein the actuator arm is situated in the slot.

4. The marine steering assist system of claim 3, wherein gaps, formed within the slot on each side of the actuator arm, define a maximum distance through which the actuator arm can move laterally.

5. The marine steering assist system of claim 4, wherein the switch is part of a switch assembly comprising two switches located opposite one another, and wherein movement of the actuator arm in one direction activates one of the switches and movement of the actuator arm in another direction activates the other of the switches.

* * * * *